United States Patent [19]

Stanley

[11] Patent Number: 4,515,006

[45] Date of Patent: May 7, 1985

[54] HOSE COUPLING CRIMPER AND METHOD OF CRIMPING

[75] Inventor: John H. Stanley, Uniontown, Ohio

[73] Assignee: The Goodyear Tire & Rubber Company, Akron, Ohio

[21] Appl. No.: 461,648

[22] Filed: Jan. 27, 1983

[51] Int..Cl.[3] ..... B21D 41/04; B21D 39/00

[52] U.S. Cl. ..... 72/402; 72/399; 72/452; 29/237

[58] Field of Search ..... 72/402, 399, 416, 76, 72/121, 452; 29/237, 508, 517

[56] References Cited

U.S. PATENT DOCUMENTS

| | | | |
|---|---|---|---|
| 2,101,888 | 12/1937 | Ambrosius | 72/399 |
| 2,381,748 | 8/1945 | Howe | 29/148 |
| 2,382,359 | 8/1945 | Weightman | 29/517 |
| 2,711,659 | 6/1955 | Foster | 72/399 |
| 3,335,594 | 8/1967 | Peterman et al. | 72/308 |
| 3,461,710 | 8/1969 | Luedi et al. | 72/402 |
| 3,461,712 | 8/1969 | Henkel et al. | 72/402 |
| 3,731,518 | 5/1973 | Blocher | 72/402 |
| 3,736,788 | 6/1973 | Olive-Jones et al. | 72/402 |
| 3,742,754 | 7/1973 | Jeromson, Jr. et al. | 72/402 |
| 3,750,452 | 8/1973 | Frank | 72/402 |
| 3,785,050 | 1/1974 | Whitledge et al. | 29/237 |
| 3,851,514 | 12/1974 | Chen et al. | 72/402 |
| 4,034,592 | 7/1977 | Chen et al. | 29/237 |
| 4,050,286 | 9/1977 | Gasler | 72/416 |
| 4,285,228 | 8/1981 | Gunning | 29/237 |
| 4,306,442 | 12/1981 | Schröck | 72/402 |

FOREIGN PATENT DOCUMENTS

| | | | |
|---|---|---|---|
| 39368 | 1/1970 | Australia . | |
| 0039200 | 11/1981 | European Pat. Off. . | |
| 0084713 | 8/1983 | European Pat. Off. . | |
| 2214339 | 9/1973 | Fed. Rep. of Germany . | |
| 2612345 | 11/1976 | Fed. Rep. of Germany . | |
| 3131681 | 5/1982 | Fed. Rep. of Germany . | |
| 2229479 | 12/1974 | France | 72/402 |
| 2341093 | 9/1977 | France . | |
| 655460 | 4/1979 | U.S.S.R. | 72/399 |

*Primary Examiner*—Daniel C. Crane

*Attorney, Agent, or Firm*—Frederick K. Lacher; T. P. Lewandowski

[57] ABSTRACT

A hose coupling crimper and method of crimping in which a pair of die plate halves are hingedly mounted on a base plate for swinging movement toward and away from a closed position with the crimping segments surrounding an opening in the base plate in which a hose and sleeve coupling is positioned. The die plate halves have radial slots for radially movable crimping segments and also restraining ring halves contained in the die plate halves for retaining the segments in the slots and determining the axial movement of the pressure ring and the crimp diameter by the thickness of the restraining ring halves. Hose and sleeve couplings of a different diameter may be crimped by using restraining ring halves of different thicknesses and/or replacing the crimping segments with segments having different diameters.

14 Claims, 4 Drawing Figures

HOSE COUPLING CRIMPER AND METHOD OF CRIMPING

This invention relates to a method of crimping couplings onto a hose and to a die assembly suitable for carrying out the method. Crimping dies have been provided to plastically deform or crimp an outer sleeve of a coupling around the end of a hose to grip the hose between the outer sleeve and a coupling nipple inside the hose. There is a need for relatively inexpensive apparatus for mounting couplings on replacement hoses in the field or at the point of use and a number of different die assemblies have been designed for this purpose. With apparatus of this type it has been difficult to provide a method of crimping where the sleeve and hose can be easily and accurately positioned in the die assembly and then held firmly in place prior to actuation of the crimping segments by a pressure ring. There has also been a need for apparatus in which the crimping segments can be easily changed to accommodate different size sleeves and at the same time hold the segments securely in the apparatus. The capability of the die assembly to crimp different size sleeves with the same dies simply by changing the thickness of a spacer is also important. These criteria have been met by the method and die assembly of this invention so that couplings can be crimped onto high pressure hose with repeatable accuracy. Also a minimum of time is required for setup and installation of this apparatus.

In accordance with one aspect of the invention, there is provided a crimping die assembly for radially compressing a sleeve against the exterior of a hose comprising a base plate having an opening for positioning the hose with the sleeve thereon, a die plate mounted on the base plate, the die plate having radial slots for slidably mounting crimping segments for movement into engagement with the sleeve, a restraining ring member positioned radially outward of the segments to restrain radially outward movement of the segments in the radial slots, a pressure ring having a tapered bore placed over tapered surfaces of the segments and power means for causing downward movement of the pressure ring into sliding engagement with tapered surfaces on the segments to move the segments into crimping engagement with the sleeve for compressing the sleeve around the hose.

In accordance with another aspect of the invention, there is provided a method of crimping a sleeve on a hose with a pair of die plate halves containing a plurality of radially movable crimping segments pivotally mounted on a base plate for swinging movement toward and away from a closed position of the segments around an opening in the base plate comprising swinging the die plate halves away from the closed position into an open position, positioning a hose in the opening with the sleeve in a predetermined axial position, swinging the die plate halves into the closed position and toward the opening to grip the sleeve, placing a pressure ring over the segments and depressing said ring in the axial direction until the sleeve is crimped on the hose, then removing the pressure ring and swinging the halves away from the sleeve in the opening to facilitate removal of the hose from the opening.

To acquaint persons skilled in the arts most closely related to the present invention, a certain preferred embodiment thereof illustrating a best mode now contemplated for putting the invention into practice is described herein by and with reference to the annexed drawings forming a part of the specification. The embodiment shown and described herein is illustrative and as will become apparent to those skilled in these arts can be modified in numerous ways within the spirit and scope of the invention defined in the claims hereof.

Figure 3:
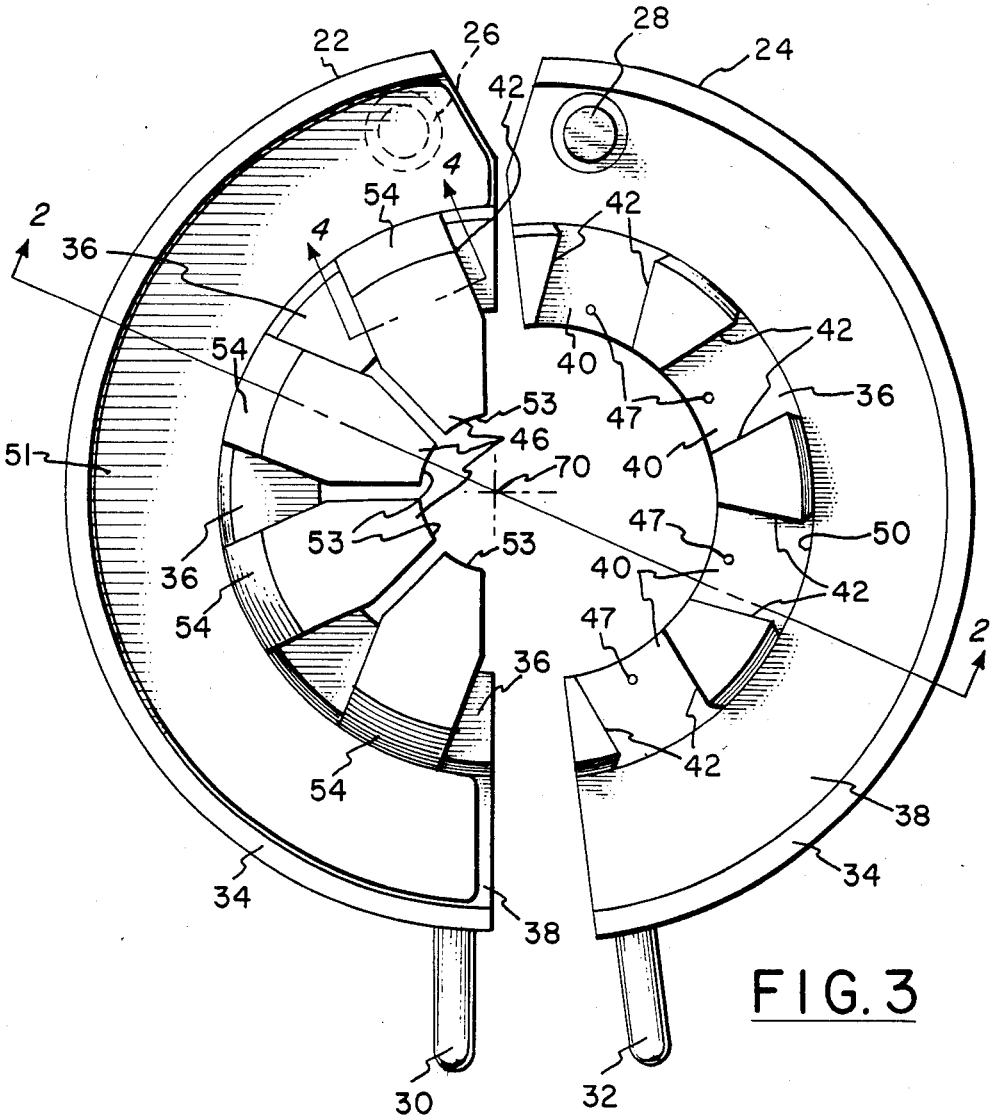

FIG. 3 is a plan view of the die plate halves in different hinged positions on the base plate. The die plate half at the left side is in the closed position with the crimping segments and the restraining ring in operating positions. The die plate half at the right side is in the open position and does not contain the crimping segments or the restraining ring.

Figure 4:
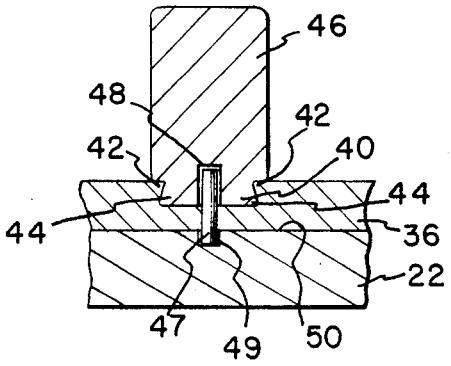

FIG. 4 is a fragmentary sectional view taken along the line 4—4 of FIG. 3 showing the dovetail connection between the crimping segments, slotted die support, and the die plate.

Figure 1:
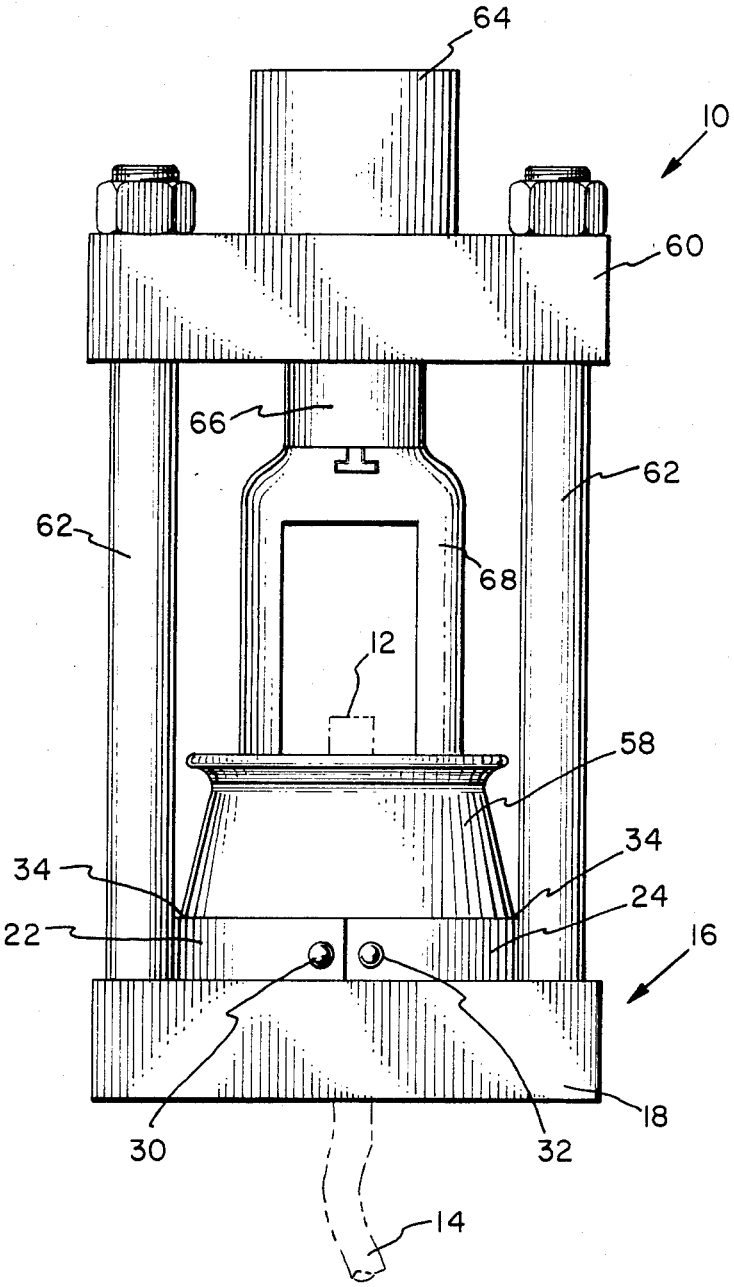
FIG. 1 is a front elevation of a hydraulic hose coupling crimper embodying the invention shown in the crimping position.

Referring to FIG. 1, a hose coupling crimper 10 for crimping a coupling 12 on the end of a hose 14 is shown. The crimper 10 includes a crimping die assembly 16 having a generally rectangular flat base plate 18 with a generally central opening 20, shown more clearly in FIG. 2, for positioning the hose 14 and coupling 12.

An annular die plate which may be split into generally semicircular die plate halves 22 and 24 is shown more clearly in FIG. 3. The die plate halves 22 and 24 are pivotally mounted on the base plate 18 for swinging movement about pivot screws 26 and 28 positioned adjacent the rear edge of the base plate away from the operator so that the die plate halves may be spread apart for easy access to the opening 20 during the positioning of the coupling 12 and hose 14 in the die assembly 16. Suitable means for swinging the die plate halves 22 and 24 about the pivot screws 26 and 28 such as handles 30 and 32 are mounted on the die plate halves adjacent the front of the base plate 18 near the operator.

Figure 2:
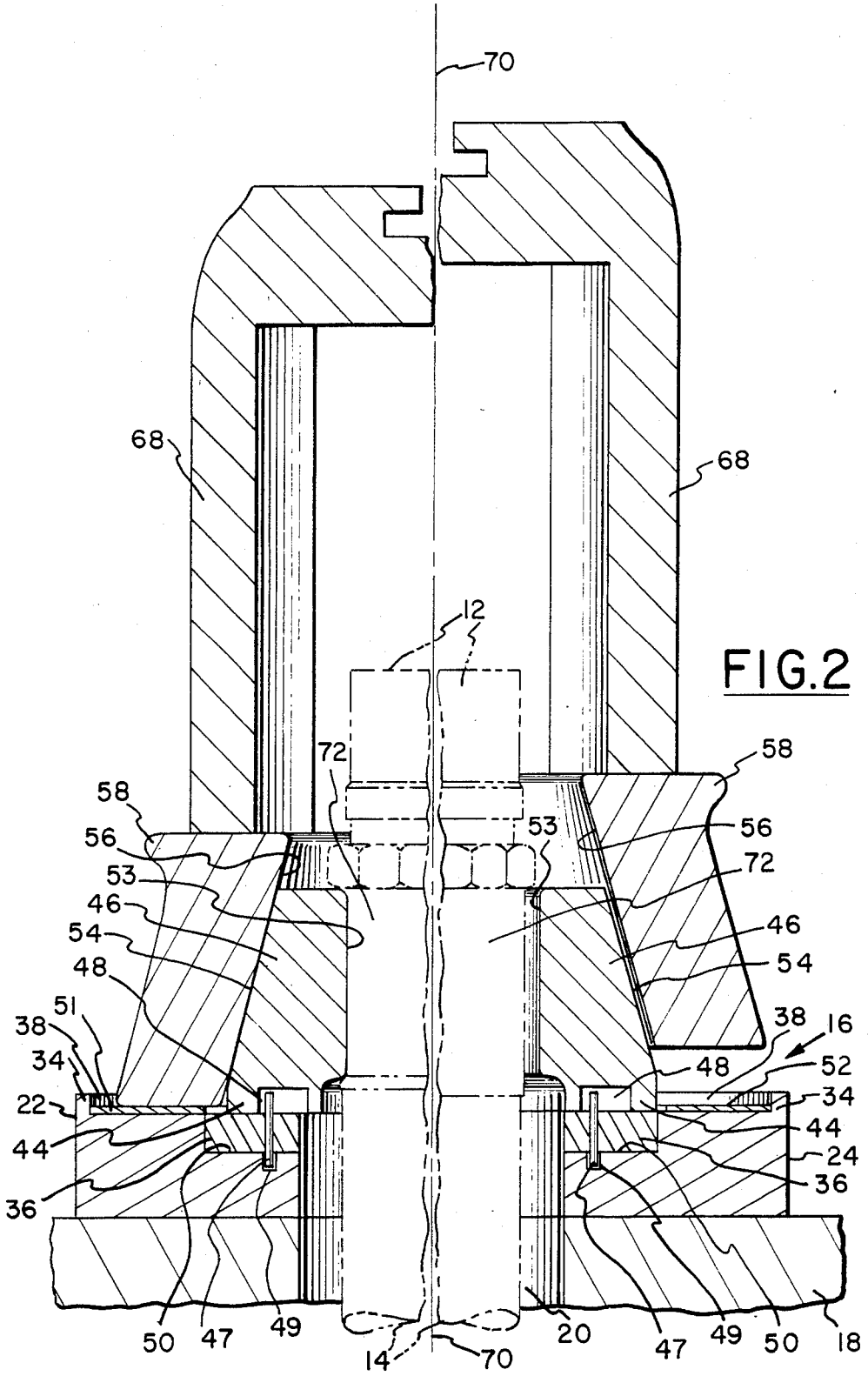
FIG. 2 is an enlarged fragmentary half sectional view of the apparatus shown in FIG. 1 taken along line 2—2 in FIG. 3 and showing the hose and coupling in chain-dotted lines. The crimping segments are shown in the retracted position at the right side and in the crimping position at the left side to illustrate the method of operation of the die assembly and the functions of the parts.

As shown more clearly in FIG. 2 and at the right side of FIG. 3 illustrating die plate half 24, each of the halves 22 and 24 has a generally flat upper surface with a shoulder portion 34 at the radially outer edge and a removable semicircular plate member with circumferentially spaced dovetail mounts forming a slotted portion 36 at the radially inner portion. The shoulder portion 34 and slotted portion 36 define a semicircular recess 38 between the shoulder and slotted portion of each of the die plate halves 22 and 24. Radial slots such as dovetail grooves 40 are defined between the dovetail mounts of the slotted portion 36 and have a dovetail cross section, as shown in FIG. 4, with radially extending edges 42 for overlapping radially extending edges of dovetail ribs 44 of crimping segments such as dies 46. The dies 46 are slidably mounted in the grooves 40 as shown in the illustration of the die plate half 22 at the left side of FIG. 3. Pins 47 mounted in the slotted portion 36 by a press fit extend into closed end slots 48 in the dies 46 for retaining the dies in the dovetail grooves 40 and at the same time permitting sliding movement of the dies. The pins 47 also project downwardly from the slotted portion 36 for insertion into holes 49 in the die plate halves 22 and 24 to locate and hold the slotted portion in a recess 50 at the radially inner edge of each of the die plate halves. Flat split rings such as restraining rings 51 and 52 having a radial width substantially the same as the width of the recess 38 are positioned in the recesses of the die plate halves 22 and 24 to restrain radially outward movement of the dies 46 in the grooves 40. As shown on the left side of FIG. 3, the dies 46 are tapered at the radially inner portions and each of the dies has an internal surface 53 which cooperatively defines a die cavity in which the coupling 12 and hose 14 may be disposed.

As shown in FIG. 2, each of the dies 46 has a tapered surface 54 in the axial direction around the outer edge corresponding to or matching a tapered bore 46 of a pressure or die ring 58. The die ring 58 may be placed around the dies 46 in the closed position of the die plate halves 22 and 24 when both halves are in the position shown at the right side of FIG. 2.

The crimper 10 includes an upper frame housing 60 which may be of a generally rectangular flat plate similar to the base plate 18 and which is connected to the base plate by connecting rods 62. Power means such as a hydraulic piston and cylinder assembly 64 is mounted on the upper frame housing 60 and includes a ram 66 actuated by the piston and engageable with a pusher 68 which may be suspended on the ram. Upon movement of the ram 66 downwardly, the pusher 68 will engage and depress the die ring 58 to provide the crimping action. The hydraulic piston and cylinder assembly 64 may be in communication with a suitable source of fluid under pressure controlled by manual or automatic valves to move the piston and ram 66 downwardly with the flow of fluid into a cylinder of the assembly 64. An internal spring in the cylinder may be provided to move the piston and ram 66 upwardly.

Preferably the base plate 18 is mounted on a horizontal work surface (not shown) with a central opening corresponding to the opening 20 in the base plate so that the coupling 12 and hose 14 may be positioned in the openings and between the dies 46. Where it is desirable, the opening 20 in the base plate 18 may include a slot extending to the front surface of the base plate. The work surface may have a corresponding slot so that the hose 14 and coupling 12 may be moved through the slots into position at the center of the die assembly 16 around a centerline 70, as shown in FIGS. 2 and 3.

The loosely assembled hose 14 and coupling 12 are shown in phantom outline in FIGS. 1 and 2. The portion of the coupling 12 to be crimped is a sleeve 72 extending around the end of the hose 14 to grip the hose between the sleeve and a coupling nipple inside the hose. To set up the die assembly 16, dies 46 and restraining ring halves 48 and 50 are selected for the size of coupling and the degree of crimping to be applied. The slotted portion 36 containing dies 46 are then placed in the recess 50 of each of the die plate halves 22 and 24. The restraining rings 51 and 52 are placed in the recess 38 of each of the die plate halves 22 and 24. The coupling 12 is then placed on the end of the hose 14 with the hose bottoming in the coupling.

In operation, the die plate halves 22 and 24 are swung about the pivot screws 26 and 28 into the open position as shown at the right side of FIG. 3. The loosely assembled hose 14 and coupling 12 are inserted through the opening 20 in the base plate 18 and the opening in the horizontal work surface to a point where a scribe line on the coupling is even with the top of the dies 46. The operator then grasps the handles 30 and 32 and swings the die plate halves 22 and 24 from an open position to the closed position, shown at the right side of FIG. 2 and at the left side of FIG. 3. The radial movement of the dies 46 is restrained by the restraining ring halves 51 and 52 such that the coupling 12 and hose 14 may be held firmly in position while the die ring 58 is placed over the dies 46. The pusher 68 may then be suspended on the ram 66 and centered over the die ring 58 as shown on the right side of FIG. 2. The hydraulic pressure in the cylinder of the piston and cylinder assembly 64 is then increased forcing the piston and ram 66 downwardly against the pusher 68. This applies pressure downwardly against the die ring 58 causing the dies 46 to be moved radially inward by the action of the die ring tapered bore 56 on the tapered surfaces 54 of the dies. As shown at the left side of FIG. 2, the travel of the die ring 58 is stopped when it engages the restraining ring half 51 which is placed around the dies 46. Restraining ring halves 51 and 52 having the desired thickness are selected to stop the travel of the die ring 58 at the point where the correct crimp diameter is achieved. As illustrated on the left side of FIG. 2, the sleeve 72 has been plastically deformed or crimped around the end of the hose 14 to grip the hose between the sleeve and a coupling nipple (not shown) inside the hose.

After the crimping operation, fluid under pressure is relieved and the piston is returned by an internal spring of the piston and cylinder assembly 64 to lift the ram 66 and pusher 68 to a position where the pusher may be removed. The die ring 58 may then be lifted off the dies 46 and the die plate halves 22 and 24 spread into the open position by swinging them about the pivot screws 26 and 28 with handles 30 and 32. The crimped coupling 12 and hose 14 may then be removed from the opening 20 in the base plate 18 and the work surface at which time the die assembly 16 is in condition for inserting another hose and coupling without having to remove the restraining ring halves 51 and 52. In this way the crimping for a certain size of coupling 12 and hose 14 is done with repeatable accuracy and a minimum of setup time.

While a certain representative embodiment and details have been shown for the purpose of illustrating the invention, it will be apparent to those skilled in the art that various changes and modifications may be made therein without departing from the spirit or scope of the invention.

What is claimed is:

1. A crimping die assembly for radially compressing a sleeve against the exterior of a hose comprising a base plate having an opening for positioning said hose with said sleeve thereon, a die plate mounted on said base plate, said die plate having radial slots, crimping segments slidably mounted in said radial slots for movement into engagement with said sleeve, said die plate being split into two die plate halves, each of said halves being pivotally mounted on said base plate for swinging movement from an open position for positioning said hose and said sleeve to a closed position around said opening in said base plate, a restraining ring member positioned radially outward of said segments to restrain radial outward movement of said segments in said radial slots, said restraining ring member being split into two generally semicircular restraining ring halves, each of said die plate halves having a recess with a shoulder portion in which one of said restraining ring halves is positioned for preventing radial movement, a pressure ring having a tapered bore movable over tapered surfaces of said segments in said closed position of said die plates halves, power means for causing movement of said pressure ring into sliding engagement with tapered surfaces on said segments to move said segments into crimping engagement with said sleeve for compressing said sleeve around said hose and said die plate halves being pivotally movable independently of the movement of said pressure ring into said closed position for gripping said sleeve at a predetermined position by said segments prior to said sliding engagement of said tapered bore on said tapered surfaces of said segments.

2. The crimping die assembly of claim 1 wherein the movement of said pressure ring into engagement with said sleeve is stopped by engagement of said pressure ring with said restraining ring member and the thickness of said restraining ring member determines the amount of radial movement of said segments for obtaining the desired crimp diameter.

3. The crimping die assembly of claim 1 wherein said means for preventing radial movement of said restraining ring halves includes a shoulder positioned around the radially outer edge of each of said die plate halves.

4. The crimping die assembly of claim 1 wherein said radial slots have radially extending edges in overlapping engagement with edges of said segments for guiding said segments in said slots.

5. The crimping die assembly of claim 4 wherein said slots have dovetail cross sections for receiving dovetail ribs of said segments.

6. The crimping die assembly of claim 3 wherein each of said die plate halves has a recess in an upper surface having substantially the same width as the radial width of each of said restraining ring halves with said shoulder at said radially outer edge and a slotted portion at a radially inner edge providing said radial slots.

7. The crimping die assembly of claim 6 wherein said slotted portion is removably mounted in a recess at said inner edge and said slotted portion includes means for retaining said segments in said slots during removal of said slotted portions from each of said die plate halves.

8. The crimping die assembly of claim 7 wherein said means for retaining said segments in said slots includees pins mounted in said slotted portion and extending upwardly into closed end slots in said segments.

9. The crimping die assembly of claim 8 wherein said pins extend downwardly from said slotted portions for insertion into holes in each of said die plate halves.

10. The crimping die assembly of claim 1 wherein said die plate halves have pivotal mountings at positions adjacent the rear edge of said base plate whereby said die plate halves may be rotated into an open position for ease of inserting and removing the hose and sleeve into and out of said opening.

11. The crimping die assembly of claim 4 wherein said die plate halves have means for swinging said halves toward and away from said positions around said opening and for holding said segments against said sleeve in said opening while said pressure ring is lowered over said segments into engagement with said tapered surfaces.

12. The crimping die assembly of claim 11 wherein said means for swinging said die plate halves includes handles mounted on said die plate halves at positions adjacent the front edge of said base plate.

13. A method of crimping a sleeve on a hose with a pair of die plate halves containing a plurality of radially movable clamping segments pivotally mounted on a base plate for swinging movement toward and away from a closed position of said segments around an opening in said base plate and with radial movement of said segments being restrained by restraining ring halves positioned in recesses with shoulder portions in each of said die plate halves to hold said sleeve and hose firmly in position comprising swinging said die plate halves away from said closed position into an open position, positioning said restraining ring halves on said die plate halves within said recesses, positioning a hose in said opening with the sleeve in a predetermined axial position, swinging said die plate halves into said closed position and toward said opening to urge said clamping segments into gripping engagement with said sleeve to retain said sleeve in said predetermined axial position, placing a pressure ring over said segments and depressing said pressure ring in the axial direction causing said segments to move only radially until said sleeve is crimped on said hose after said die plate halves are moved into said closed position and said clamping segments have been urged into gripping engagement with said sleeve, then removing said pressure ring and swinging said halves away from said sleeve in said opening to facilitate removal of said hose from said opening.

14. A method in accordance with claim 13 wherein the axial movement of said pressure ring determines the crimp diameter of said segments and the amount of axial movement of said pressure ring is determined by the thickness of said restraining ring halves, said method further comprising positioning said restraining ring halves of a predetermined thickness on said die plate halves before placing said pressure ring over said segments to obtain a predetermined crimping diameter of said segments.

* * * * *